US010131141B2

(12) United States Patent
Akimoto

(10) Patent No.: US 10,131,141 B2
(45) Date of Patent: Nov. 20, 2018

(54) INKJET HEAD AND INKJET PRINTER

(71) Applicant: TOSHIBA TEC KABUSHIKI KAISHA, Shinagawa-ku, Tokyo (JP)

(72) Inventor: Manabu Akimoto, Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/414,745

(22) Filed: Jan. 25, 2017

(65) Prior Publication Data

US 2017/0291413 A1 Oct. 12, 2017

(30) Foreign Application Priority Data

Apr. 7, 2016 (JP) ..... 2016-077471

(51) Int. Cl.
*B41J 2/045* (2006.01)

(52) U.S. Cl.
CPC ..... *B41J 2/04573* (2013.01); *B41J 2/04541* (2013.01); *B41J 2/04543* (2013.01); *B41J 2/04555* (2013.01); *B41J 2/04581* (2013.01)

(58) Field of Classification Search
CPC B41J 2/04573; B41J 2/04555; B41J 2/04543; B41J 2/04581; B41J 2/04541
See application file for complete search history.

(56) References Cited

U.S. PATENT DOCUMENTS 8,939,532 B2 1/2015 Ono et al.
2002/0109414 A1 8/2002 Nitta et al.
2005/0116977 A1* 6/2005 Shinkawa ..... B41J 2/0451 347/14
2013/0257945 A1* 10/2013 Shinkawa ..... B41J 2/04541 347/10
2016/0039199 A1 2/2016 Hiyoshi et al.
2016/0121606 A1 5/2016 Kimura et al.

FOREIGN PATENT DOCUMENTS

WO 2017/111068 6/2017

OTHER PUBLICATIONS

Extended European Search Report for European Patent Application No. 17157138.3 dated Aug. 24, 2017.
Chinese Office Action for Chinese Patent Application No. 20170063835.5 dated Jun. 1, 2018.

* cited by examiner

*Primary Examiner* — Yaovi M Ameh
(74) *Attorney, Agent, or Firm* — Amin, Turocy & Watson LLP

(57) ABSTRACT

In accordance with an embodiment, an inkjet head comprises a head section, a clock signal generator, a drive controller and a current measurement section. The head section applies a drive voltage to a wall surface of an ink chamber and ejects ink from the ink chamber. The clock signal generatorsends a clock signal to the head section. The drive controller stops the clock signal sent to the head section, and applies a predetermined drive voltage to the head section. The current measurement section measures a current flowing to the head section while the drive controller stops the clock signal sent to the head section.

20 Claims, 5 Drawing Sheets

INKJET HEAD AND INKJET PRINTER

CROSS-REFERENCE TO RELATED APPLICATIONS

This application is based upon and claims the benefit of priority from Japanese Patent Application No. P2016-077471, filed Apr. 7, 2016, the entire contents of which are incorporated herein by reference.

FIELD

Embodiments described herein relate generally to an inkjet head and an inkjet printer.

BACKGROUND

A controller of an inkjet head outputs a driving signal to a head section. The head section ejects ink according to the driving signal. There are times when the head section generates a leakage current due to a failure caused by damage or aging.

DETAILED DESCRIPTION

A technology for detecting a leakage current generated in the head section is desired. In accordance with an embodiment, an inkjet head comprises a head section, a clock signal generation section or generator, a drive control section or drive controller, and a current measurement section. The head section applies a drive voltage to a wall surface of an ink chamber and ejects ink from the ink chamber. The clock signal generation section generates a clock signal to be supplied to or sends the clock signal to the head section. The drive control section stops the supply of the clock signal to the head section, and applies a predetermined drive voltage to the head section. The current measurement section measures a current flowing to the head section while the drive control section stops the supply of the clock signal to the head section.

In another embodiment, an inkjet printing method involves applying a drive voltage to a wall surface of an ink chamber and ejecting ink from the ink chamber; sending a clock signal to a head section; stopping the clock signal sent to the head section, and applying a predetermined drive voltage to the head section; and measuring a current flowing to the head section while stopping the clock signal sent to the head section.

Hereinafter, an embodiment is described with reference to the accompanying drawings.

A printing system according to the embodiment ejects ink to a medium (for example, a paper) and forms an image on the medium. For example, the printing system forms a predetermined image on the medium according to an operation from an operator.

Figure 1:
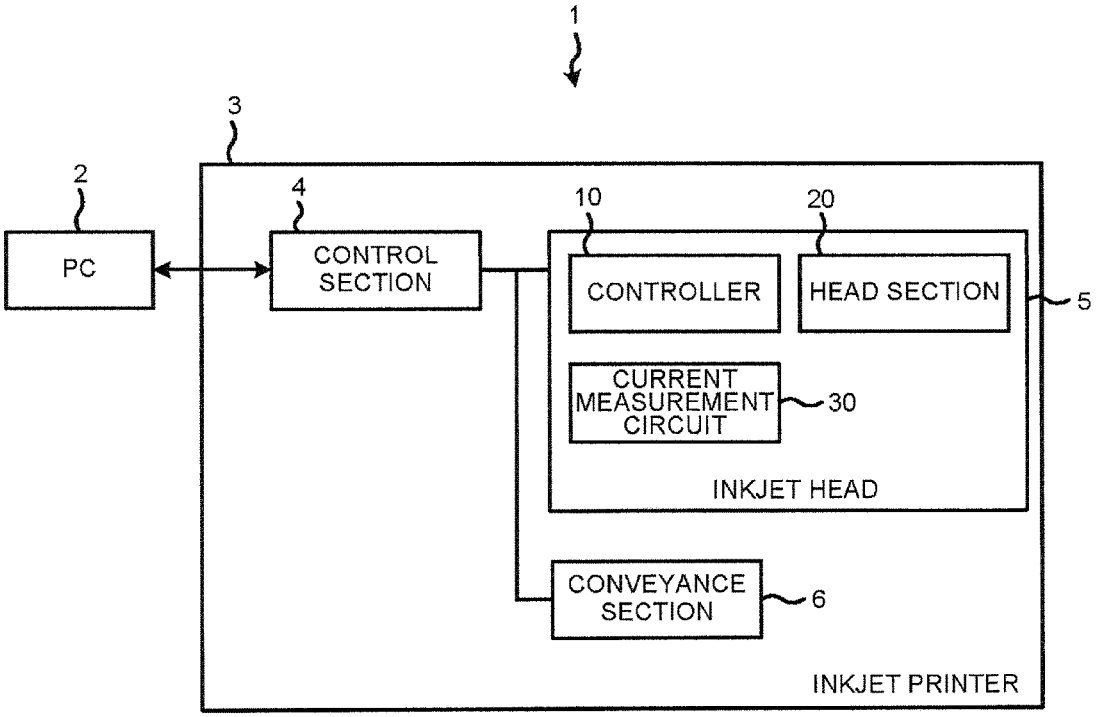
FIG. 1 is a block diagram illustrating an example of the configuration of a printing system according to an embodiment.

FIG. 1 is a block diagram illustrating an example of the configuration of a printing system 1. As shown in FIG. 1, the printing system 1 is provided with a PC 2 and an inkjet printer 3.

The PC 2 sends image data formed on the medium to an inkjet head 5. For example, the PC 2 is provided with an operation section for receiving an input of an operation from the operator. The PC 2 sends the image data to the inkjet head 5 according to the operation input via the operation section.

The PC 2 is, for example, a desktop PC, a notebook PC, a tablet PC, or smart phone.

The inkjet printer 3 ejects the ink stored in the ink cartridge to the medium and forms the image on the medium.

As shown in FIG. 1, the inkjet printer 3 is provided with a control section 4, an inkjet head 5 and a conveyance section 6.

The control section 4 includes a function for controlling the whole operation of the inkjet printer 3. The control section 4 is composed of, for example, a CPU, a ROM, a RAM and an NVM. The control section 4 realizes various processing by executing a program stored in advance in an internal memory, the ROM or the NVM.

The inkjet head 5 ejects the ink to the medium on the basis of a signal from the control section 4. The inkjet head 5 is described later.

The conveyance section 6 conveys the medium on a predetermined conveyance route on the basis of the signal from the control section 4. For example, the conveyance section 6 is provided with a table for absorbing and fixing the medium and a drive section for conveying the table. The conveyance section 6 conveys the table through the drive section and conveys the medium which is absorbed and fixed on the table.

Next, the inkjet head 5 is described.

Figure 2:
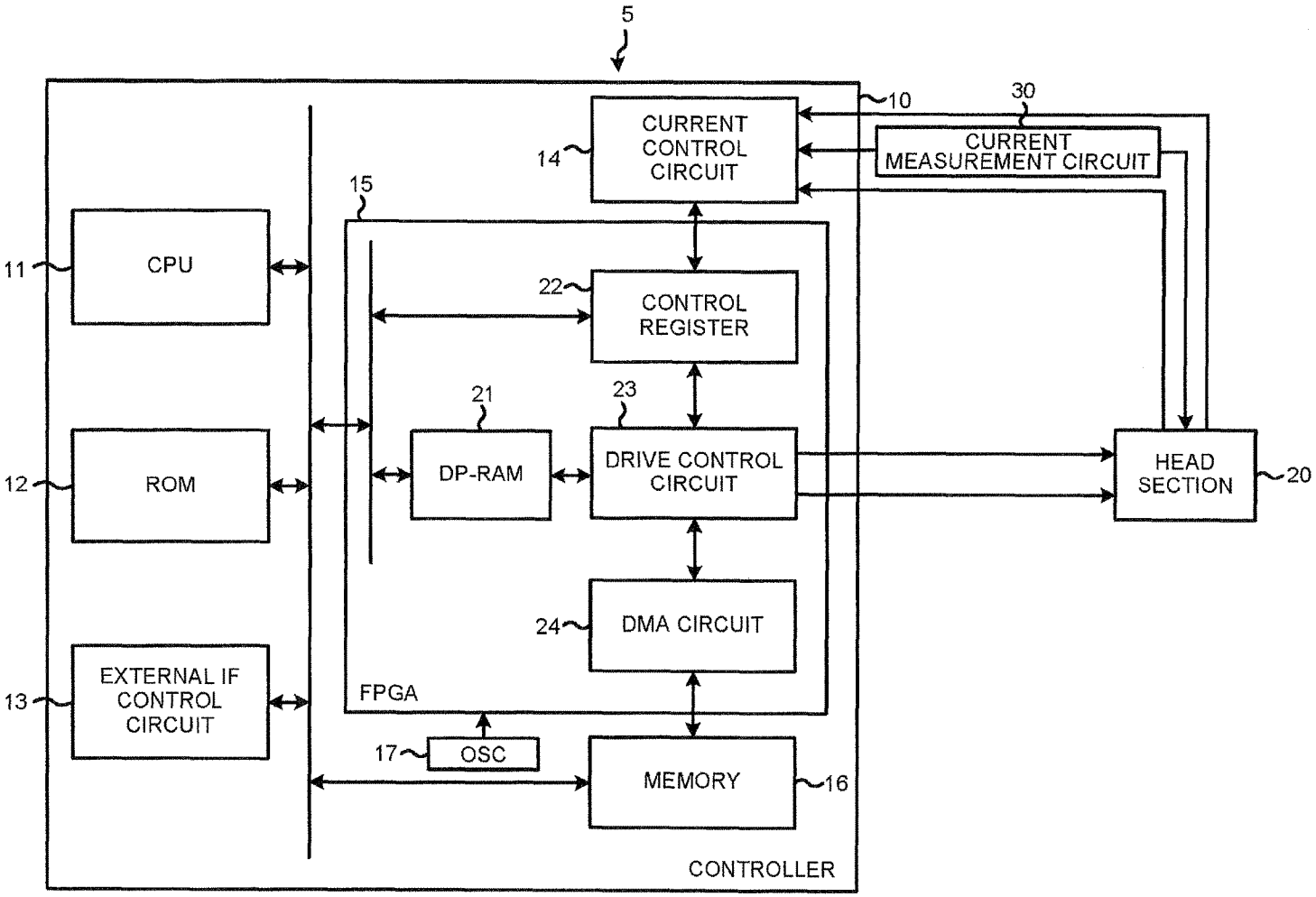
FIG. 2 is a block diagram illustrating an example of the configuration of an inkjet head according to the embodiment.

FIG. 2 is a block diagram illustrating an example of the configuration of the inkjet head 5.

As shown in FIG. 2, the inkjet head 5 is provided with a controller 10, a head section 20 and a current measurement circuit 30 (current measurement section).

The controller 10 drives the head section 20 on the basis of a signal from the control section 4. For example, the controller 10 generates a driving signal for driving the head section 20 on the basis of the signal from the control section 4. The controller 10 outputs the generated driving signal to the head section 20 to drive the head section 20. The controller 10 is constituted by, for example, an IC.

The head section 20 ejects the ink on the basis of the driving signal from the controller 10. The head section 20 is a share mode head that shares wall surfaces forming the ink chamber with the ink chambers. Herein, the head section 20 carries out three division on a plurality of the ink chambers, and ejects the ink from each division (a first division, a second division and a third division) in order.

For example, the head section 20 is provided with the ink chamber for storing the ink and a drive circuit for driving the wall surface of the ink chamber. The ink chamber is connected with the ink cartridge, and supplies the ink from the ink cartridge. The drive circuit applies a drive voltage to the ink chamber in order to form a predetermined image according to the driving signal. The wall surface of the ink chamber is formed by piezoelectric elements, and drives according to the drive voltage output by the drive circuit. The volume of the inside of the ink chamber is changed due to the drive of the wall surface. The head section 20 ejects the ink stored inside from an ejection hole as the volume of the ink chamber is changed.

The head section 20 receives setting data, print data and a timing signal from the controller 10. The head section 20 ejects the ink on the basis of the received setting data, the print data and the timing signal. For example, if receiving the print data corresponding to a predetermined division, the head section 20 latches the print data by a clock for transferring the print data. The head section 20 applies the driving signal to the wall surface of the ink chamber and ejects the ink on the basis of the latched print data in synchronization with the timing signal indicating the next division timing.

The current measurement circuit 30 measures a current from the controller 10 to the head section 20. The current measurement circuit 30 measures the current flowing to a route in which the current control circuit 14 supplies electric power to the head section 20. For example, the current measurement circuit 30 is provided with a resistance, and measures a current on the basis of a voltage generated in the resistance.

The current measurement circuit 30 sends the measured current value to the control section 4.

The control section 4 sends the current value to the PC 2 if receiving the current value from the current measurement circuit 30. The PC 2 displays the current value on a display section if receiving the current value.

As shown in FIG. 2, the controller 10 is provided with a CPU 11, a ROM 12, an external interface control circuit 13, a current control circuit 14, a FPGA (Field Programmable Gate Array) 15, a memory 16 and an OSC (oscillator and like) 17. The CPU 11 communicates with the ROM 12, the external interface control circuit 13, the current control circuit 14, the FPGA 15 and the memory 16 via a bus line. The FPGA 15 is provided with a DP (Dual Port)-RAM 21, a control register 22, a drive control circuit 23 (drive control section) and a DMA (Direct Memory Access) circuit 24.

The CPU 11 includes a function for controlling the whole operation of the controller 10. The CPU 11 may be provided with an internal cache and various interfaces. The CPU 11 realizes various processing by executing a program (code) previously stored in an internal memory, the ROM 12 or a NVM which is not shown. The CPU 11 is, for example, a processor.

Apart of various functions which are realized in such a manner that the CPU 11 executes the program may be realized by a hardware circuit. In this case, the CPU 11 controls the functions executed by the hardware circuit.

The ROM 12 is a nonvolatile memory in which a program for control and control data are stored in advance. The control program and the control data which are stored in the ROM 12 are integrated in advance in accordance with the specification of the controller 10. The ROM 12, for example, stores a program (for example, BIOS) for controlling a circuit board of the controller 10.

The external interface control circuit 13 controls an interface for transmitting and receiving data to and from an external device on the basis of a signal from the CPU 11.

The current control circuit 14 controls the electric power supplied to the head section 20 on the basis of a control signal from the FPGA 15 and a head status from the head section 20. For example, the current control circuit 14 acquires a temperature of the head section 20 as the head status. The current control circuit 14 controls the voltage supplied to the head section 20 on the basis of the control signal and the head status.

The FPGA 15 controls the current control circuit 14 and the head section 20 on the basis of a signal from the CPU 11.

The memory 16 stores the print data. For example, the memory 16 stores the print data for each line. Further, the memory 16 stores the print data for each division. For example, if the head section 20 ejects the ink in the case of the three division, the memory 16 stores first division transfer data, second division transfer data and third division transfer data for each line. The first division transfer data is the print data for ejecting the ink from the first division. The second division transfer data is the print data for ejecting the ink from the second division. The third division transfer data is the print data for ejecting the ink from the third division.

The OSC (oscillator and like) 17 supplies a source message signal for clock supply to the head section 20 to the FPGA 15.

The DP-RAM 21 stores a signal sent from the CPU 11 to the drive control circuit 23.

The control register 22 temporarily stores data required for executing a processing by the drive control circuit 23.

The drive control circuit 23 sends the driving signal to the head section 20 according to the print data. Further, the drive control circuit 23 sends a clock signal to the head section 20. The drive control circuit 23 is described later.

The DMA circuit 24 acquires the print data from the memory 16 on the basis of a signal from the drive control circuit 23. The DMA circuit 24 sends the acquired print data to the drive control circuit 23.

Next, the drive control circuit 23 is described.

Figure 3:
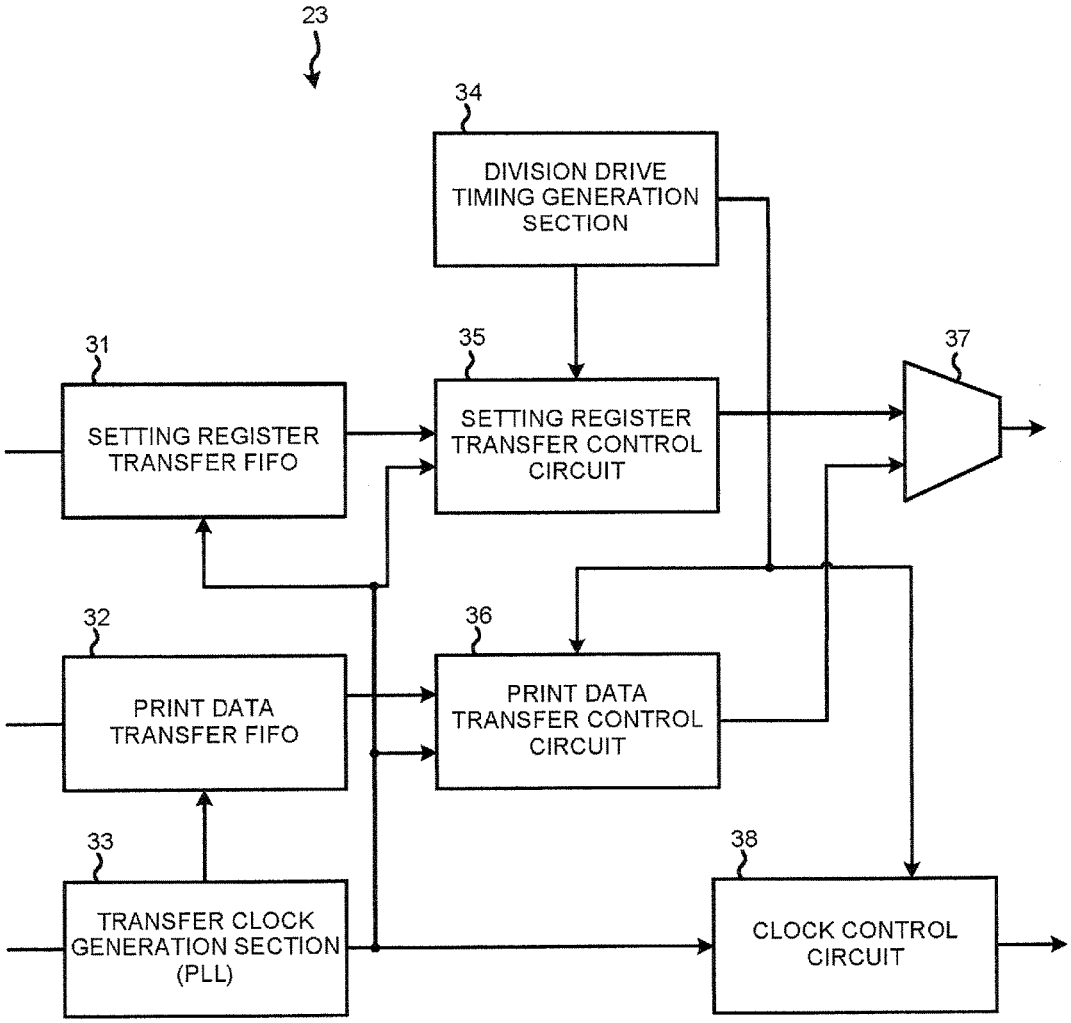
FIG. 3 is a block diagram illustrating an example of the configuration of a drive control circuit according to the embodiment.

FIG. 3 is a block diagram illustrating an example of the configuration of the drive control circuit 23.

As shown in FIG. 3, the drive control circuit 23 is provided with a setting register transfer FIFO 31, a print data transfer FIFO 32, a transfer clock generation section 33 (clock signal generation section), a division drive timing generation section 34 (timing signal generation section) , a setting register transfer control circuit 35, a print data transfer control circuit 36, a selector 37 and a clock control circuit 38.

The setting register transfer FIFO 31 receives setting data from the DP-RAM 21 or the control register 22 and stores the received setting data. The setting register transfer FIFO 31 sends the stored setting data to the setting register transfer control circuit 35 in the received order.

The print data transfer FIFO 32 receives the print data from the DMA circuit 24 and stores the received print data. The print data transfer FIFO 32 sends the stored print data to the print data transfer control circuit 36 sent to in the received order.

The transfer clock generation section 33 generates the clock signal used for transferring the data to the head section 20. The transfer clock generation section 33 receives the supply of the source message signal from the external OSC (oscillator and the like) 17, and generates the clock signal on the basis of the source message signal. The transfer clock generation section 33 supplies the generated clock signal to the setting register transfer FIFO 31, the print data transfer FIFO 32, the setting register transfer control circuit 35, the print data transfer control circuit 36 and the clock control circuit 38. The clock signal is, for example, a pulse wave with a predetermined interval.

The division drive timing generation section 34 generates a timing at which the setting data or the print data is sent for each division. The division drive timing generation section 34 sends a timing signal for notifying the timing to other clocks.

For example, the division drive timing generation section 34 generates a pulse at a predetermined interval. The division drive timing generation section 34 notifies other clocks of the timing by sending the generated pulse to other clocks as the timing signal.

The division drive timing generation section 34 sends the timing signal to the setting register transfer control circuit 35, the print data transfer control circuit 36 and the clock control circuit 38.

The setting register transfer control circuit 35 sends the setting data received from the setting register transfer FIFO 31 to the selector 37. The setting register transfer control circuit 35 sends the setting data to the selector 37 according to the timing signal received from the division drive timing generation section 34.

The print data transfer control circuit 36 sends the print data received from the print data transfer FIFO 32 to the selector 37. The print data transfer control circuit 36 sends the print data to the selector 37 according to the timing signal received from the division drive timing generation section 34.

The selector 37 selectively outputs data from the setting register transfer control circuit 35 or the print data transfer control circuit 36 to the head section 20 on the basis of a signal from another clock. For example, the selector 37 outputs the setting data from the setting register transfer control circuit 35 to the head section 20 at a timing at which desired sending should be carried out. Further, the selector 37 outputs the print data from the print data transfer control circuit 36 to the head section 20 at a timing at which the desired sending should be carried out.

The clock control circuit 38 stops the supply of the clock signal to the head section 20 on the basis of the timing signal. In other words, the clock control circuit 38 supplies the clock signal generated by the transfer clock generation section 33 to the head section 20, or stops the supply of the clock signal at a predetermined timing.

Next, the clock control circuit 38 is described.

Figure 4:
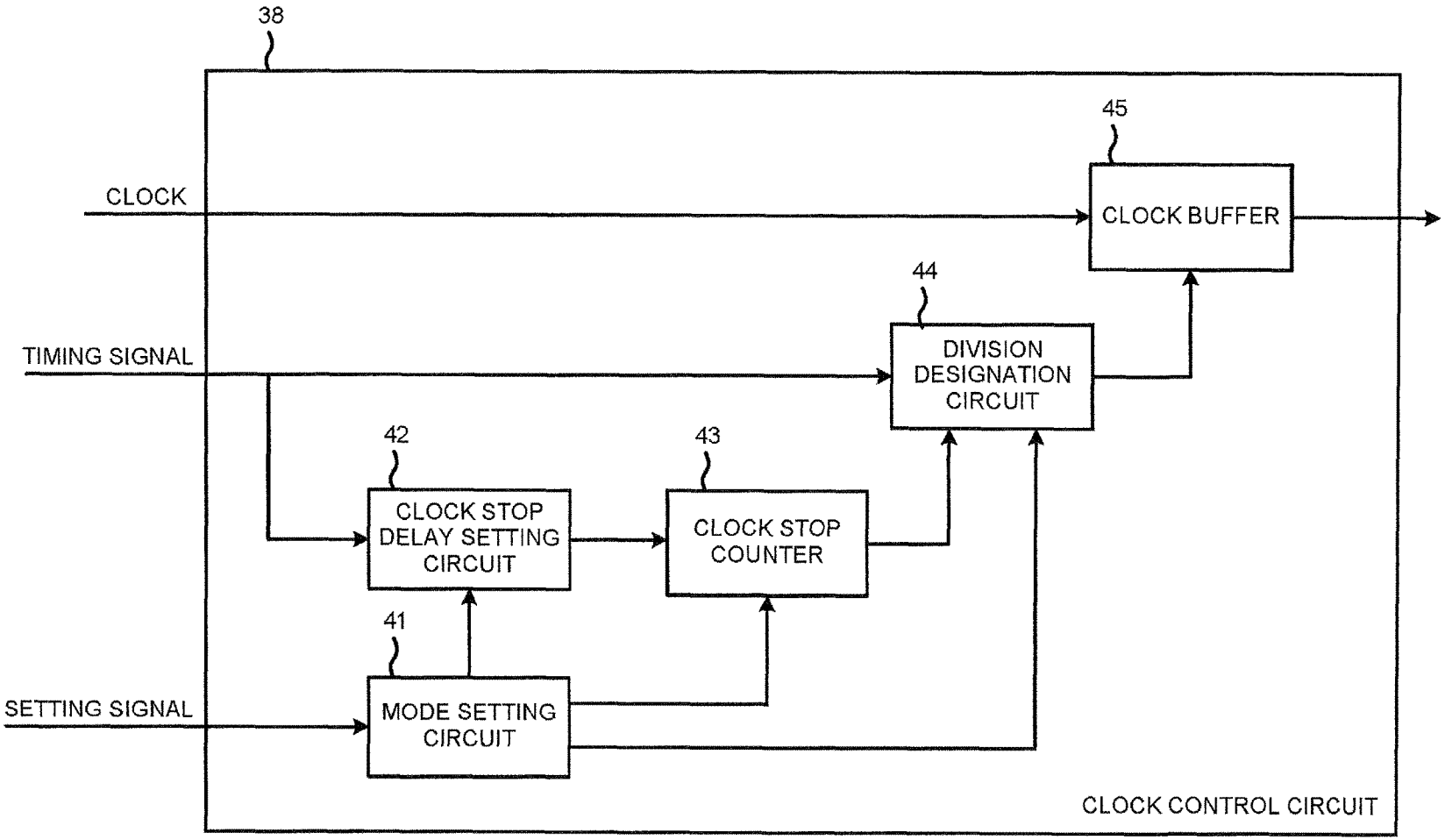
FIG. 4 is a block diagram illustrating an example of the configuration of a clock control circuit according to the embodiment.

FIG. 4 is a block diagram illustrating an example of the configuration of the clock control circuit 38.

As shown in FIG. 4, the clock control circuit 38 is provided with a mode setting circuit 41, a clock stop delay setting circuit 42, a clock stop counter 43, a division designation circuit 44 and a clock buffer 45.

The mode setting circuit 41 sets a period during which the supply of the clock signal is stopped. For example, the mode setting circuit 41 receives a setting signal indicating a period during which the supply of the clock signal is stopped, and sets the period during which the supply of the clock signal is stopped on the basis of the setting signal.

The setting signal includes stop object division, delay time and stop time.

The stop object division indicates division for stopping the supply of the clock signal. In other words, during a period during which the stop object division ejects the ink, the clock control circuit 38 stops the supply of the clock signal. For example, the stop object division is the first division, the second division or the third division.

The delay time indicates time from a start time of the period during which the stop object division ejects the ink (in other words, time at which the timing signal of the stop object division is sent) to a moment the supply of the clock signal is stopped. In other words, the clock control circuit 38 waits for a delay period after receiving the timing signal, and stops the supply of the clock signal.

The stop time is time at which the supply of the clock signal is stopped. In other words, the stop time is time from a moment the supply of the clock signal is stopped to a moment the supply of the clock signal is started. For example, the stop time is several seconds to dozens of seconds.

The mode setting circuit 41 sends the stop object division to the division designation circuit 44. Further, the mode setting circuit 41 sends-the delay time to the clock stop delay setting circuit 42. Further, the mode setting circuit 41 sends the stop time to the clock stop counter 43.

The clock stop delay setting circuit 42 sets the delay time. The clock stop delay setting circuit 42 receives the delay time from the mode setting circuit 41, and sets the received delay time. For example, the clock stop delay setting circuit 42 starts clocking if receiving the timing signal. The clock stop delay setting circuit 42 sends a stop signal for stopping the supply of the clock signal to the clock stop counter 43 and the division designation circuit 44 if the clocked time reaches the delay time.

The clock stop counter 43 sets the stop time. The clock stop counter 43 receives the stop time from the mode setting circuit 41, and sets the received stop time. For example, the clock stop counter 43 starts clocking if receiving the stop signal from the clock stop delay setting circuit 42. The clock stop counter 43 sends a start signal for starting the supply of the clock signal to the division designation circuit 44 if the clocked time reaches the stop time.

The division designation circuit 44 sets the stop object division for stopping the clock signal. In other words, the division designation circuit 44 receives the stop object division from the mode setting circuit 41, and sets the received stop object division.

Further, the division designation circuit 44 sends an enable signal for supplying the clock signal to the head section 20 to the clock buffer 45. Further, the division designation circuit 44 sends a disenable signal for stopping the supply of the clock signal to the head section 20 to the clock buffer 45.

For example, the division designation circuit 44 receives the timing signal from the division drive timing generation section 34. The division designation circuit 44 waits for until receiving the stop signal from the clock stop delay setting circuit 42 in a case in which the received timing signal is the timing signal of the stop object division. The division designation circuit 44 sends the disenable signal to the clock buffer 45 if receiving the stop signal.

Further, the division designation circuit 44 waits for until receiving the start signal from the clock stop counter 43. The division designation circuit 44 sends the enable signal to the clock buffer 45 if receiving the start signal.

The clock buffer 45 supplies the clock signal from the transfer clock generation section 33 to the head section 20 on the basis of a signal from the division designation circuit 44. Further, the clock buffer 45 stops the supply of the clock signal to the head section 20 on the basis of a signal from the division designation circuit 44.

The clock buffer 45 stops the supply of the clock signal to the head section 20 if receiving the disenable signal from the division designation circuit 44. Further, the clock buffer 45 starts the supply of the clock signal to the head section 20 if receiving the enable signal from the division designation circuit 44. Furthermore, the clock buffer 45 may supply the clock signal to the head section 20 in the initial state.

Next, an example of operations of the drive control circuit 23 is described.

Figure 5:
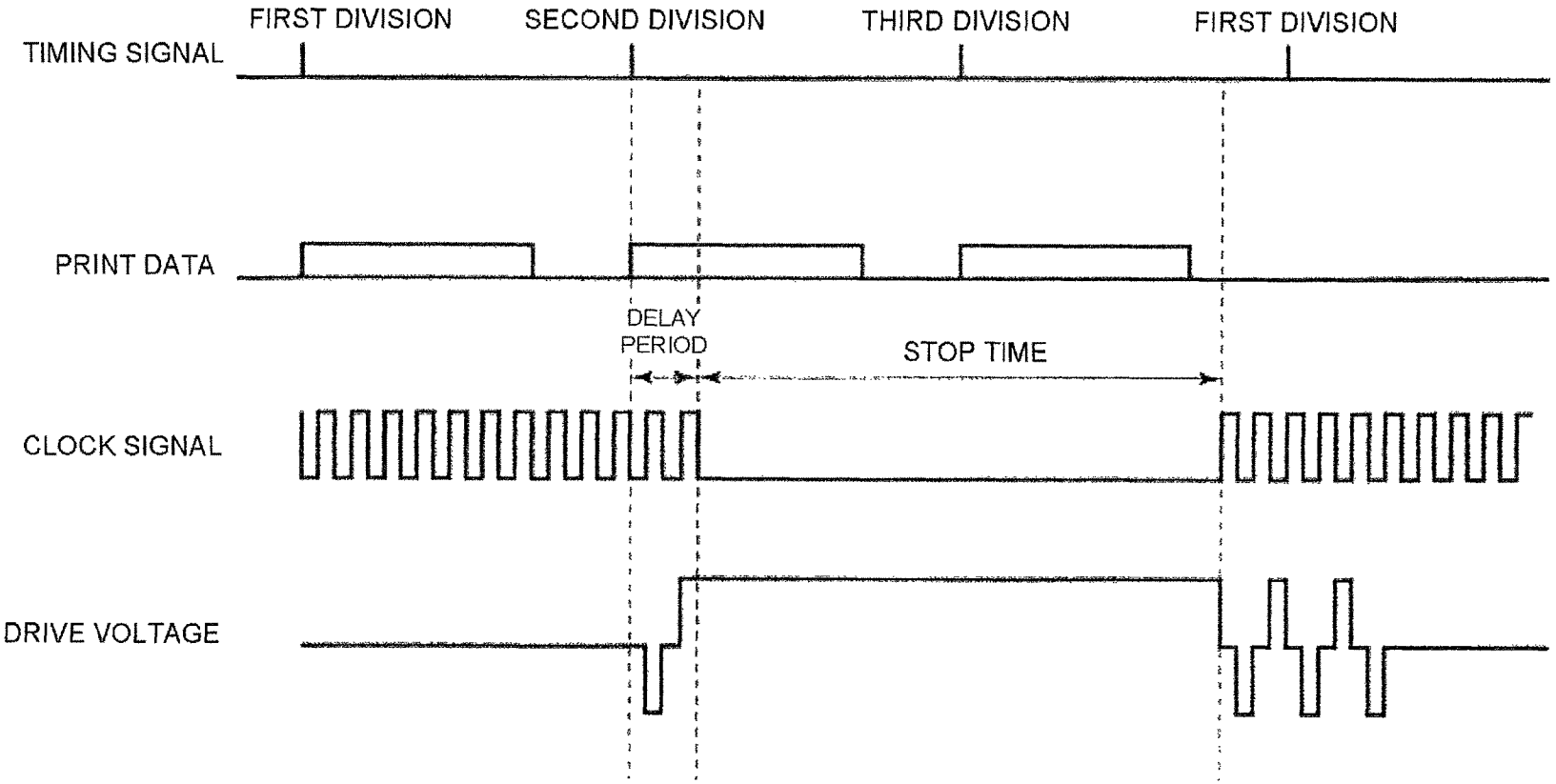
FIG. 5 is a timing chart illustrating an example of signals generated in the drive control circuit according to the embodiment.

FIG. 5 is a timing chart illustrating a signal of each section of the drive control circuit 23 and the drive voltage of the head section 20.

FIG. 5 illustrates a "timing signal", "print data" and a "clock signal" and a "drive voltage".

The "timing signal" is the timing signal which is output by the division drive timing generation section 34. Herein, the division drive timing generation section 34 outputs the timing signal of the first division, the timing signal of the second division and the timing signal of the third division in order.

The "print data" indicates the print data which is sent to the head section 20 by the selector 37. In other words, the "print data" indicates the print data which is sent to the head section 20 by the drive control circuit 23.

The "clock signal" indicates the clock signal which is sent to the head section 20 by the clock control circuit 38.

The "drive voltage" indicates the drive voltage which is applied to the wall surface of the ink chamber by the drive circuit of the head section 20.

Herein, it is assumed that the drive control circuit 23 ends the sending of the setting data to the head section 20. Further, it is assumed that the memory 16 stores the print data. It is assumed that the mode setting circuit 41 receives the setting signal of which the stop object division is the second division. Further, the current measurement circuit 30 continues to measure the current output to the head section 20 by the controller 10.

Firstly, the mode setting circuit 41 receives the setting signal. The mode setting circuit 41 sends the delay time indicated by the setting signal to the clock stop delay setting circuit 42 if receiving the setting signal. The mode setting circuit 41 sends the stop time indicated by the setting signal to the clock stop counter 43. Further, the mode setting circuit 41 sends the stop object division (herein, the second division) indicated by the setting signal to the division designation circuit 44.

The clock stop delay setting circuit 42 sets the received delay time. The clock stop counter 43 sets the received stop time. The division designation circuit 44 sets the received stop object division.

If each section carries out setting based on the setting signal, the division drive timing generation section 34 sends the timing signal of the first division to the print data transfer control circuit 36. Furthermore, the division drive timing generation section 34 may send the timing signal of the first division to the clock stop delay setting circuit 42, the division designation circuit 44 and the head section 20.

The print data transfer control circuit 36 receives a division timing signal of the first division from the division drive timing generation section 34. The print data transfer control circuit 36 sends the print data to the head section 20 via the selector 37 if receiving the division timing signal of the first division.

The head section 20 receives and latches the print data.

If the head section 20 latches the print data and predetermined time elapses, the division drive timing generation section 34 sends the timing signal of the second division to the print data transfer control circuit 36, the clock stop delay setting circuit 42, the division designation circuit 44 and the head section 20.

The drive circuit of the head section 20 applies the driving signal to the wall surface of the ink chamber on the basis of the latched print data if receiving the timing signal of the second division.

The print data transfer control circuit 36 sends the print data to the head section 20 via the selector 37 if receiving the timing signal of the second division from the division drive timing generation section 34.

The clock stop delay setting circuit 42 starts clocking if receiving the timing signal of the second division. If the clocked time reaches the delay time, the clock stop delay setting circuit 42 sends the stop signal to the clock stop counter 43 and the division designation circuit 44.

The division designation circuit 44 sends the disenable signal to the clock buffer 45 if receiving the stop signal. The clock buffer 45 stops the supply of the clock signal to the head section 20 if receiving the disenable signal.

If the supply of the clock signal to the head section 20 is stopped, the drive circuit of the head section 20 outputs a predetermined voltage as the drive voltage. For example, the drive circuit of the head section 20 outputs a peak voltage of the pulse.

The clock stop counter 43 starts clocking if receiving the stop signal. The clock stop counter 43 sends the start signal to the division designation circuit 44 if the clocked time reaches the stop time.

The division designation circuit 44 sends the enable signal to the clock buffer 45 if receiving the start signal.

The clock buffer 45 starts the supply of the clock signal to the head section 20 if receiving the enable signal.

If the supply of the clock signal to the head section 20 is started, the driving signal of the head section 20 restarts the output of the drive voltage based on the latched print data.

Further, while the clock buffer 45 stops the supply of the clock signal, the division drive timing generation section 34 sends the timing signal of the third division to the print data transfer control circuit 36. The print data transfer control circuit 36 sends the print data to the head section 20 via the selector 37 if receiving the timing signal of the third division.

The current measurement circuit 30 at least measures the current output to the head section 20 by the drive control circuit 23 while the supply of the clock signal is stopped. The current measurement circuit 30 sends the measured current value to the control section 4. The control section 4 receives the current value. The control section 4 sends the current value to the PC 2 if receiving the current value.

The PC 2 receives the current value from the control section 4. The PC 2 displays the received current value on the display section and presents the current value to the operator if receiving the current value.

Further, the head section 20 may be provided with a cap in order that the ink is not ejected to the ejection hole of the ink chamber.

The inkjet head constituted as stated above can stop the supply of the clock signal to the head section during a predetermined period. As a result, the head section applies a predetermined voltage to the wall surface of the ink chamber during a period during which the clock signal is stopped.

If the predetermined voltage is applied to the wall surfaces of the ink chamber, electric charge is charged between the wall surfaces of the ink chamber. As a result, after the predetermined period elapses, the current flowing to the wall surface of the ink chamber becomes 0.

The current measuring circuit of the inkjet head measures the current flowing to the head section while the clock signal is stopped. In other words, the current measuring circuit of the inkjet head measures the current flowing to the wall surface of the ink chamber.

For example, in a case in which the current measured by the current measuring circuit is gradually reduced from a point of time at which the clock signal is stopped and almost becomes 0 after the predetermined time elapses, it can be determined that the electric charge is charged between the wall surfaces of the ink chamber. As a result, it can be determined that the leak current is not generated in the head section.

Further, in a case in which the current measured by the current measuring circuit is constant or gradually rises from the point of time at which the clock signal is stopped, it can be determined that the electric charge is not charged between the wall surfaces of the ink chamber. As a result, it can be determined that the electric charge which should be charged between the wall surfaces of the ink chamber flows out as the leak current. Thus, it can be determined that the leak current is generated.

For example, if the inkjet head stops the supply of the clock signal and measures the current with the current measuring circuit at the time of start of print or at the time of manufacture, the operator who checks the current can determine whether or not the leak current is generated in the head.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An inkjet head, comprising:

a head section configured to apply a drive voltage to a wall surface of an ink chamber and eject ink from the ink chamber;

a clock signal generator configured to send a clock signal to the head section;

a drive controller configured to stop the clock signal sent to the head section, and apply a predetermined drive voltage to the head section; and a current measurement section configured to measure a current flowing to the head section while the drive controller stops the clock signal sent to the head section, wherein a change in the measure of the current flowing to the head section indicates whether leakage current is generated in the head section.

2. The inkjet head according to claim 1, further comprising:

a timing signal generator configured to send a timing signal indicating a timing corresponding to a division of the head section, wherein the drive controller stops the clock signal sent to the head section after receiving the timing signal indicating the timing corresponding to a predetermined division.

3. The inkjet head according to claim 2, wherein the drive controller stops the clock signal sent to the head section if a delay time elapses after receiving the timing signal.

4. The inkjet head according to claim 1, wherein the drive controller sends the clock signal to the head section after the stop time elapses after stopping the clock signal sent to the head section.

5. The inkjet head according to claim 1, wherein the wall surface comprises at least one piezoelectric element.

6. The inkjet head according to claim 1, wherein the clock signal sent is required to cause a change in volume of the ink chamber.

7. The inkjet head according to claim 3, wherein the delay time indicates time from a start time of a period during which a timing signal of a stop object division is sent to a moment the clock signal sent is stopped.

8. An inkjet printer, comprising:

an inkjet head; and a conveyance section configured to convey a medium on which an image is formed by ink, the inkjet head comprising:

a head section configured to apply a drive voltage to a wall surface of an ink chamber and eject ink from the ink chamber;

a clock signal generator configured to send a clock signal to the head section;

a drive controller configured to stop the clock signal sent to the head section, and apply a predetermined drive voltage to the head section; and a current measurement section configured to measure a current flowing to the head section while the drive controller stops the clock signal sent to the head section, wherein the current flowing measured by the current measurement section is utilized to detect a leakage current generated in the head section.

9. The inkjet printer according to claim 8, further comprising:

a timing signal generator configured to send a timing signal indicating a timing corresponding to a division of the head section, wherein the drive controller stops the clock signal sent to the head section after receiving the timing signal indicating the timing corresponding to a predetermined division.

10. The inkjet printer according to claim 9, wherein the drive controller stops the clock signal sent to the head section if a delay time elapses after receiving the timing signal.

11. The inkjet printer according to claim 8, wherein the drive controller sends the clock signal to the head section after the stop time elapses after stopping the clock signal sent to the head section.

12. The inkjet printer according to claim 8, wherein the wall surface comprises at least one piezoelectric element.

13. The inkjet printer according to claim 8, wherein the clock signal sent causes a change in volume of the ink chamber.

14. An inkjet printing method, comprising:

applying a drive voltage to a wall surface of an ink chamber and ejecting ink from the ink chamber;

sending a clock signal to a head section;

stopping the clock signal sent to the head section, and applying a predetermined drive voltage to the head section; and measuring a current flowing to the head section while stopping the clock signal sent to the head section, wherein the measuring the current flowing to the head section comprises evaluating the current flowing for a presence of a leakage current generated in the head section.

15. The inkjet printing method according to claim 14, further comprising:

sending a timing signal indicating a timing corresponding to a division of the head section; and stopping the clock signal sent to the head section after receiving the timing signal indicating the timing corresponding to a predetermined division.

16. The inkjet printing method according to claim 15, further comprising:

stopping the clock signal sent to the head section if a delay time elapses after receiving the timing signal.

17. The inkjet printing method according to claim 14, further comprising:

sending the clock signal to the head section after the stop time elapses after stopping the clock signal sent to the head section.

18. The inkjet printing method according to claim 14, wherein the wall surface comprises at least one piezoelectric element.

19. The inkjet printing method according to claim 14, wherein the clock signal sent causes a change in volume of the ink chamber.

20. The inkjet printing method according to claim 16, wherein the delay time indicates time from a start time of a period during which a timing signal of a stop object division is sent to a moment the clock signal sent is stopped.

* * * * *